United States Patent [19]

Eisenhart

[11] Patent Number: 4,979,754

[45] Date of Patent: Dec. 25, 1990

[54] PORTABLE BEACH GAME

[76] Inventor: Michael F. Eisenhart, 806 Pennypack Circle, Hatboro, Pa. 19040-3526

[21] Appl. No.: 505,571

[22] Filed: Apr. 6, 1990

[51] Int. Cl.[5] ..... A63B 71/02

[52] U.S. Cl. ..... 273/411; 206/315.1; 273/29 BB

[58] Field of Search ..... 273/411, 413, 407, 26 A, 273/181 F, 29 B–29 BG, 29 R, 317; 206/315.1, 579, 315.9; 135/904, 120; 248/127, 346, 910

[56] References Cited

U.S. PATENT DOCUMENTS

| | | | |
|---|---|---|---|
| 906,848 | 12/1908 | Atwell | 273/29 BG |
| 2,163,456 | 6/1939 | Youngberg | 273/342 |
| 2,771,294 | 11/1956 | MacChesney | 273/411 X |
| 3,216,681 | 11/1965 | Tagliavia | 248/127 X |
| 3,580,578 | 5/1971 | McCarthy | 273/342 |
| 3,968,968 | 7/1976 | Peterson | 273/411 |
| 4,088,317 | 5/1978 | Gierla | 273/31 |
| 4,093,224 | 6/1978 | Hale | 273/29 BB X |
| 4,119,301 | 10/1978 | Payne | 273/29 BD X |
| 4,135,716 | 1/1979 | Ginsburg | 273/29 BC |
| 4,145,044 | 3/1979 | Wilson et al. | 248/910 X |
| 4,317,515 | 3/1982 | Feeley | 206/579 X |
| 4,355,813 | 10/1982 | Rathjen | 273/411 |
| 4,372,561 | 2/1983 | Morgan et al. | 273/411 |
| 4,518,166 | 4/1985 | Trott | 273/411 |
| 4,523,762 | 6/1985 | Garner, Sr. | 273/411 |
| 4,595,155 | 6/1986 | Gough | 273/29 BE X |
| 4,732,395 | 3/1988 | Halverson | 273/411 |
| 4,880,243 | 11/1989 | Raub | 273/411 |

FOREIGN PATENT DOCUMENTS

| | | | |
|---|---|---|---|
| 1401328 | 7/1975 | United Kingdom | 273/411 |

OTHER PUBLICATIONS

"Flaghouse Wholesale Catalogue of Phys. Ed., Recreation, Maring and Camping Supplies", Winter 1980–81, p. 20–Advertisement for "Floor Tennis".

*Primary Examiner*—Edward M. Coven
*Assistant Examiner*—Sebastiano Passaniti
*Attorney, Agent, or Firm*—Wall and Roehrig

[57] ABSTRACT

A game that is suitable for use on a beach or on similar loose granular soil wherein a ball is hit back and forth over a net. The net is suspended between two hollow supports over a foldable ground sheet that delineates part of the playing region. The sheet combines with the loose soil to furnish a rebounding surface for the ball. Each support has a wide base and an upright post that are filled with sand or water to provide additional weight to the supports to hold a net suspended therebetween in a taut condition over the ground sheet. The net can be folded and stored in one support along with other game related equipment which the ground sheet can be similarly stored in the other support. Handles are mounted upon each support to provide for ease of transportation.

10 Claims, 2 Drawing Sheets

PORTABLE BEACH GAME

BACKGROUND OF THE INVENTION

This invention relates to a tennis like game that can be played at the beach or on loose granular surfaces.

Tennis like games of the type wherein a ball is passed back and forth over a net generally demand that the ball bounce at least once on the surface of the court. These types of games typically cannot be played on sandy or loose granular surfaces which do not permit the ball to rebound upon or striking the court surface. Furthermore, it is difficult to erect and anchor the net in a taut condition on these type of surfaces. Guide wires and stakes are sometimes used to anchor the net, however, these devices pose a hazard to players and others who might fall or become entangled therewith.

Youngberg, in U.S. Pat. No. 2,163,456 describes a paddle ball game suitable for use on a beach. The game employs a relatively small and thus easily portable wooden court that has correspondingly small nets secured thereto. The players stand behind their respective sides of the court and attempt to bounce the ball back and forth without hitting one of the nets. Due to the relatively small size of the net, a great deal of skill is required to play the game and accordingly, the game is not attractive to a large segment of the general public.

Gierla, in U.S. Pat. No. 4,088,317 discloses a tennis like game wherein the net and the court boundaries can be retracted into the net post by means of mechanical reels for storage. Although the game is portable and can be conveniently stored away when not in use, it can only be played on relatively hard surfaces from which a ball can easily rebound. Furthermore, the moving parts of the retracting mechanism will become fouled with sand and grit if the game were used at a beach or the like.

SUMMARY OF THE INVENTION

It is therefore an object of the present invention to improve tennis-like games so that the game can be played on sandy beaches or other similar loose granular surfaces.

It is a further object of the present invention to provide a tennis like beach game that is easily portable and can be stored away in a compact space saving package.

A still further object of the present invention is to a beach game that does not pose a danger to the players or others within the playing area.

Yet a further object of the present invention is to provide a tennis like beach game that has no moving parts that might become fouled by sand or grit.

Another object of the present invention is to provide a net game for use on a beach that does not require the use of potentially hazardous stakes and guide wires to support the net.

These and other objects of the present invention are attained by means of a tennis-like game that is intended to be played on a beach or any other playing area having a loose granular surface which might absorb the energy of the ball and thus prevent the ball from rebounding or which precludes the net from being securely anchored in a safe manner. The game includes a rectangular shaped foldable ground sheet that defines at least a portion of the playing surface. The sheet is made of a synthetic material, such as plastic, that provides a rebounding surface for the ball when it is spread upon loose granular or sandy soil. A pair of hollow net supports are positioned at midcourt on either side of the sheet. Each support has a relatively wide horizontally disposed base section and a vertically disposed post. The top of the post is open to permit the support to be filled with water or sand to provide sufficient weight so that a net can be suspended between the posts in a taut condition. Each post contains a removable cap and the net and the ground sheet can be conveniently stored within the posts along with other game related equipment.

BRIEF DESCRIPTION OF THE DRAWINGS

For a better understanding of these and other objects of the invention reference will be made to the following detailed description of the invention which is to be read in association with the accompanying drawing, wherein.

DESCRIPTION OF THE INVENTION

Figure 1:
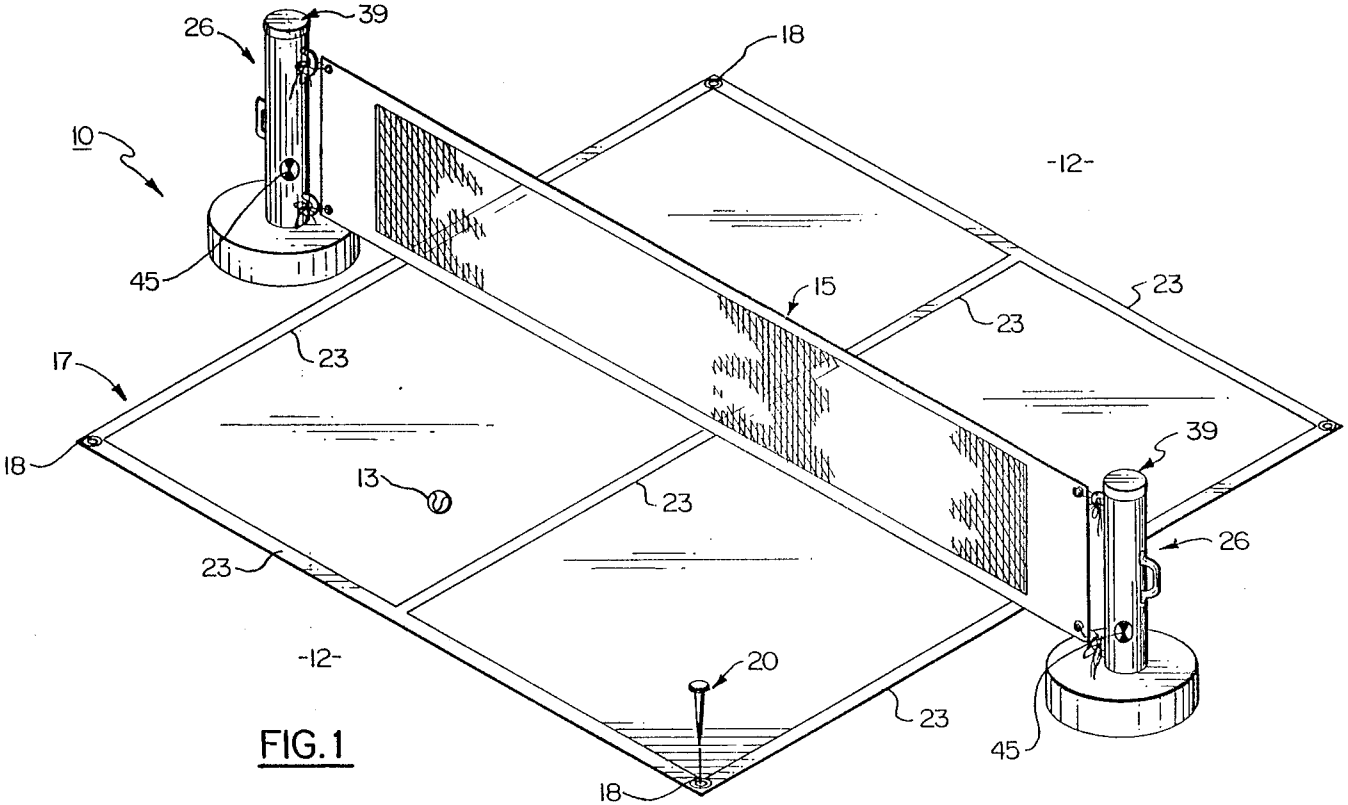
FIG. 1 is a perspective view showing the component parts of the game assembled in a playing condition.

Turning initially to FIG. 1 the game, which is generally referenced 10, is shown erected upon a beach 12 or a similar playing surface having loose granular soil of the type that will not permit a ball to bounce thereon or a net to be securely anchored therein. The game which is tennis-like in nature, requires a ball 13 to be passed back and forth over a net 15 that spans the midcourt region defined by ground sheet 17. The ball is struck by the players using their hands, paddles, rackets, or the like (not shown). As in tennis, it is intended that a ball served by one player will pass cleanly over the net and bounce in a portion of the court defined by the ground sheet before being returned by the opposing player.

The ground sheet is fabricated from a commercially available plastic material, that has sufficient flexibility so that it can be folded or rolled into a relatively small package the reason for which will be explained in greater detail below. Although the sheet is flexible enough to be folded, it will provide sufficient rigidity when spread upon a sandy surface so that a rubber ball striking it will rebound or bounce high enough to permit the ball to be returned by a player. Preferably, the properties of the sheet are matched with those of the ball to maintain the amount of rebound within desired limits.

A grommet 18 is mounted in each of the four corners of the ground sheet which permits the sheet to be held in place by means of pegs 20 that are passed through each grommet and driven into the ground. Each peg, is made preferably of hard rubber and includes an elongated shank 21 (FIG. 2) of sufficient length to permit the peg to penetrate deeply into the soil beneath the ground sheet. Each peg also includes an expanded low profile head 22 from which the shank depends. The corners of the head are all rounded so that the head does not pose a danger to those using the game or passing through the court region.

The ground sheet is furnished with clearly discernable boundary markers 23—23 which define four serving boxes 25—25 much like a tennis court. The net is suspended directly over the midcourt section of the sheet at a height best suited to accommodate the balls rebounding properties. The net may be set to any desired height depending on the rebounding characteristics of the ball for a given soil.

Figure 2:
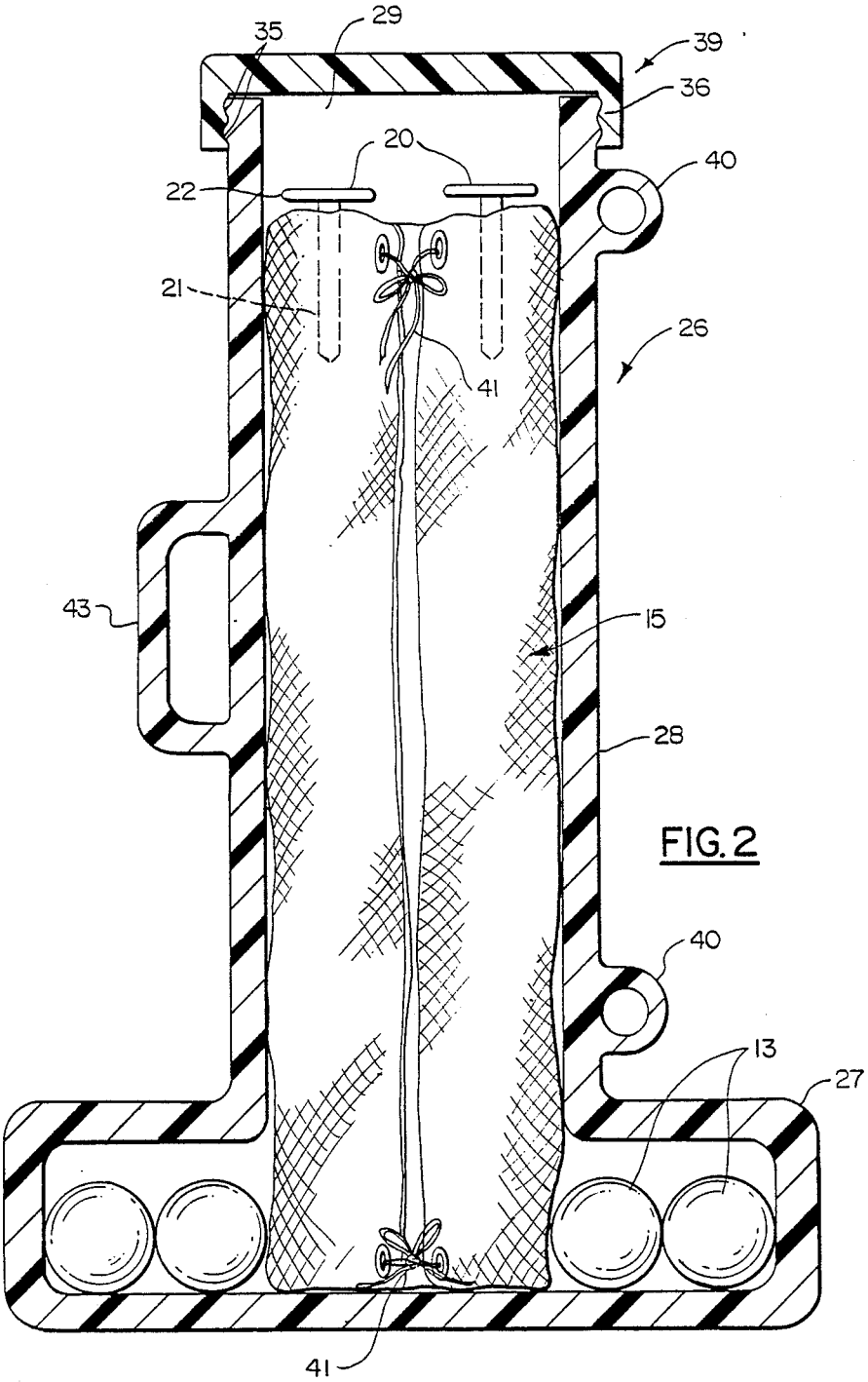
FIG. 2 is an enlarged side elevation in a section of one of the hollow net supports showing game related equipment stored therein.

The net is suspended between two support units generally referenced 25—25. The supports are molded from a thermoplastic material to the same size and shape. Each support includes a circular base 27 that is integral and coaligned with a raised cylindrical post 28. Both the base and the post are hollow members, and as seen in FIG. 2, provide ample interval storage space for game related components. As illustrated in FIG. 2, the net 15 can be rolled up and inserted into the post through the top opening 29. A number of balls 13—13 can be stored in the base and rubber pegs 20—20 used to hold down the ground sheet can also be inserted into the folds of the rolled up net. Although not shown, the ground sheet 17 can be similarly folded or rolled up and stored in the other net support unit.

The top outer surface of each post has a series of circular grooves 35—35 molded therein that mate with complimentary ridges, 36—36 molded into a cylindrical cap 39 used to close the post and thus help retain the goods stored inside the support. The molded cap is arranged to snap into a closed, and locked position as shown in FIG. 2 but yet can be easily removed to gain access to goods stored inside the support.

A pair of spaced apart virtually aligned eyelets 40—40 are molded into the body of each post. The eyelets are adapted to receive therethrough chords 41—41 (FIG. 2) secured to the opposing ends of the net. A carrying handle 43 is also molded into each post directly opposite to the eyelets to provide a convenient handhold for the user when the game is being transported from place to place, as for example, from an automobile to a playing site.

The diameter of the support unit is considerably larger than that of the companion posts so that the center of gravity 45 of the support lies about midway between the bottom surface of the base and the mid-height of the support. This coupled with the wide base prevents the support from being easily tripped over. When placed in use, the support units are emptied of equipment and are filled with either water or sand to considerably increase the weight of each unit. With the addition of the extra weight, the net can be mounted tightly between the support units and will remain taut, even under the most vigorous game conditions, without the aid of potentially hazardous wires and/or stakes. When finished with the game, the water or sand used to fill the support units can be returned to its natural surrounding with out creating environmental problems. Once emptied the support units can be filled with game related equipment for easy transportation and storage.

While this invention has been described with specific reference to the structure disclosed herein, it is not confined to the details as set forth and this application is intended to cover any modifications and changes as may come within the scope of the following claims.

What is claimed is:

1. An easily transportable and storable beach game that is played by hitting a ball back and forth across a net that includes a foldable rectangular sheet that is spreadable upon the ground to define at least a portion of a playing court, said sheet combining with the ground to provide a rebounding surface for a ball, a pair of hollow net support units positionable on either side of the sheet at the mid-court region, each support unit having a hollow base and a hollow post integral with said base, the width of the base being related to the height of the post so that the center of gravity of the support is located along the axis of the post below the mid-height of said support, each post having an open top to permit the support to be at least partially filled with water or sand to provide additional weight to said support, each support unit post further including a pair of axially spaced connecting means for attaching a net thereto, and a net having attaching means at opposite ends thereof for securing the net to the connecting means of said posts whereby the net is suspended across the court.

2. The beach game of claim 1 wherein said net support unit each includes a handle means positioned opposite said connecting means by which said unit can be carried.

3. The beach game of claim 1 wherein each hollow support unit has an interior shape and volume which permit the net to be folded up and stored in one support unit and the ground sheet to be folded up and stored in the second support unit.

4. The beach game of claim 3 that further includes a cap means for closing said top opening in each post.

5. The beach game of claim 1 wherein said ground sheet contains grommet means at each corner of said sheet and further includes peg means slidably received in each grommet means for penetrating into the ground to hold said sheet against the ground.

6. The beach game of claim 2 wherein the support units are molded of plastic and said handle means and said connecting means are integrally molded with the post of each support.

7. The beach game of claim 1 wherein the hollow base of each support unit is arranged to accommodate a number of balls therein.

8. The beach game of claim 5 wherein each peg means is formed of hard rubber and contains an expanded head having a low profile that does not pose a hazard to one playing the game.

9. The beach game of claim 1 wherein said ground sheet further includes boundary means for dividing the playing region into a plurality of zones.

10. The beach game of claim 1 wherein the ground sheet is made of a plastic material.

* * * * *